US007020405B2

(12) United States Patent
Ishikawa et al.

(10) Patent No.: US 7,020,405 B2
(45) Date of Patent: Mar. 28, 2006

(54) IMAGE FORMING DEVICE CAPABLE OF INTERRUPTING APPLICATION OF DRIVING SIGNAL AT A DRIVE UNIT

(75) Inventors: Satoru Ishikawa, Aichi-ken (JP); Fumio Morita, Aichi-ken (JP); Fumikazu Sato, Inuyama (JP); Hideaki Deguchi, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 32 days.

(21) Appl. No.: 10/700,630

(22) Filed: Nov. 5, 2003

(65) Prior Publication Data

US 2004/0156647 A1 Aug. 12, 2004

(30) Foreign Application Priority Data

Nov. 5, 2002 (JP) ..... P2002-320830

(51) Int. Cl.
*G03G 15/00* (2006.01)
*G03G 15/02* (2006.01)
*G03G 15/06* (2006.01)
*G03G 15/16* (2006.01)

(52) U.S. Cl. ..... 399/50; 399/43; 399/53; 399/66

(58) Field of Classification Search ..... 399/50, 399/53, 55, 66, 43, 46, 82, 149, 150
See application file for complete search history.

(56) References Cited

U.S. PATENT DOCUMENTS

| | | | | |
|---|---|---|---|---|
| 4,772,914 A | | 9/1988 | Kinoshita et al. | 399/88 |
| 5,099,287 A | | 3/1992 | Sato | 399/45 |
| 5,287,149 A | | 2/1994 | Hoshika | 399/138 |
| 5,692,232 A | | 11/1997 | Okano et al. | 399/53 |
| 5,697,013 A | * | 12/1997 | Sasaki | 399/55 |
| 5,845,172 A | * | 12/1998 | Saito et al. | 399/50 |
| 6,157,794 A | * | 12/2000 | Katsumi et al. | 399/53 |
| 2004/0005159 A1 | * | 1/2004 | Ito et al. | 399/50 |

FOREIGN PATENT DOCUMENTS

| | | |
|---|---|---|
| JP | B2 6-27953 | 11/1984 |
| JP | A 59-218469 | 12/1984 |
| JP | A 62-201470 | 9/1987 |
| JP | A 1-99075 | 4/1989 |
| JP | A 6-214442 | 8/1994 |
| JP | A 06-214442 | 8/1994 |
| JP | A 6-282126 | 10/1994 |
| JP | A 2000-292993 | 10/2000 |

* cited by examiner

*Primary Examiner*—Sophia S. Chen
(74) *Attorney, Agent, or Firm*—Oliff & Berridge, PLC

(57) ABSTRACT

During printing on a thick paper, a Scorotron charger disposed upstream of a developing roller in a drum rotational direction charges a photosensitive drum to about 1000 V. Then a transfer roller disposed downstream of the developing roller lowers the potential to about 80 V. The transfer bias is turned off at the end of printing at T1 and does not lower the surface potential after this. When the surface of the drum opposite the transfer roller reaches a position opposite the Scorotron charger at T2, a DC motor and a charging bias are turned off. The surface potential of the drum that passes opposite the developing roller remains at about 400 V and is higher than developing roller potential until the photosensitive drum comes to a complete stop after idling at T3. This prevents the developing agent from adhering to the photosensitive drum.

15 Claims, 6 Drawing Sheets

IMAGE FORMING DEVICE CAPABLE OF INTERRUPTING APPLICATION OF DRIVING SIGNAL AT A DRIVE UNIT

BACKGROUND OF THE INVENTION

1. Field of the Invention

The present invention relates to an image forming device that makes it hard for toner to adhere to an idling photosensitive drum after the image forming device is powered off.

2. Description of the Related Art

Typical laser printers, copiers and other image forming devices include a photosensitive drum (electrostatic latent image bearing member) having a charge generating layer and a charge transport layer on a base material layer. A corona discharge or other process is performed to pre-charge the photosensitive drum and form an electrostatic latent image on the photosensitive drum by exposing the photosensitive drum to laser, LED or other types of light. The electrostatic latent image is made visible through the use of toner or other developing agent. The toner image is transferred to paper or other recording medium and thermally fixed by a thermal fixing device.

Generally, the photosensitive drum is a cylindrical shape and rotates around an axis extending in a direction perpendicular to the sheet feeding direction. The photosensitive drum is rotated by drive power transmitted from a drive source via gears or other drive power transmission mechanism. A charging unit, an exposure unit that exposes the drum to light, a developing unit that develops electrostatic latent image formed on the drum to a visible image using toner, and a transfer unit that transfers the toner image onto a recording medium are disposed around the photosensitive drum in confronting relation with the outer periphery of the drum.

If the gear reduction ratio of the drive power transmission mechanism interposed between the drive source and the photosensitive drum is increased for the sake of making a more compact image forming device and saving energy, the load on the photosensitive drum is lowered. This increases photosensitive drum idling when transmission of driving force to the photosensitive drum ends after forming the image. If, for example, positively charged toner is used, the surface of the photosensitive drum whose potential has been lowered by the transfer unit will reach the nip area (the area of actual contact between the photosensitive drum and the developing unit) through the idling of the photosensitive drum causing toner to move from the developing unit to the photosensitive unit. The toner that adheres to the photosensitive drum moves to the transfer unit, which is in contact with the photosensitive drum, at next printing soiling the rear side of the paper during printing.

The application of the charging bias by the charging unit is continued until the photosensitive drum stops completely allowing the charging unit to control the potential relationship between the idling photosensitive drum and the developing unit. This means that the nip area of the photosensitive drum 27 has a higher potential than the developing unit preventing toner from the developing unit to adhere to the photosensitive drum as disclosed in Japanese Patent Application Publication No. 62-201470 and 6-214442.

The above patent application stipulates that charging by the charging unit be continued until the photosensitive drum stops. This means that the photosensitive drum is partially charged in the time period immediately before the photosensitive drum stops and until the photosensitive drum stops, which reduces the service life of the photosensitive drum.

SUMMARY OF THE INVENTION

This invention has been made to solve the above problem, and accordingly, it is an object of the invention to provide an image forming device that prevents adhesion of the developing agent on the developing agent bearing member to the electrostatic latent image bearing member, such as a photosensitive drum, while also preventing a reduction in electrostatic latent image bearing member service life due to partial charging.

In order to achieve the above and other objects, there is provided an image forming device that includes a photosensitive drum, a driving unit, a drive signal generating unit, a charging unit, a charging bias applying unit, a developing agent bearing member, a transfer unit, and a control unit. The photosensitive drum is rotatable in a predetermined direction about an axis and has a peripheral surface on which an electrostatic latent image is formed. The drive signal generating unit generates a drive signal to be applied to the driving unit and rotates the photosensitive drum in response to the drive signal. The charging unit is disposed in confrontation with the photosensitive drum and electrically charges the photosensitive drum. The charging bias applying unit applies a charging bias to the charging unit. The developing agent bearing member is disposed in confrontation with the photosensitive drum in a position further downstream than the charging unit with respect to the predetermined direction in which the photosensitive drum rotates. The developing agent bearing member forms a developed image on the photosensitive drum by applying developing agent on the electrostatic latent image on the photosensitive drum. The transfer unit is disposed in confrontation with the photosensitive drum in a position further upstream than the charging unit with respect to the predetermined direction but further downstream than the developing agent bearing member. The transfer unit transfers the developed image on the photosensitive drum onto a recording medium. The control unit controls the charging bias applying unit to terminate application of the charging bias to the charging unit at a time before rotations of the photosensitive drum stops completely by interrupting application of the drive signal from the drive signal generating unit to the driving unit. The control unit also controls a potential between the photosensitive drum and the developing agent bearing member so that a lesser amount of the developing agent on the developing agent bearing member adheres to the photosensitive drum before the photosensitive drum stops completely.

DETAILED DESCRIPTION OF THE PREFERRED EMBODIMENTS

A laser printer 1 according to a preferred embodiment of the invention will be described with reference to the accompanying drawings. In the following description, the terms "upward", "downward", "upper", "lower", "above", "below", "beneath" and the like will be used throughout the description assuming that the laser printer 1 is disposed in an orientation in which it is intended to be used.

Figure 1:
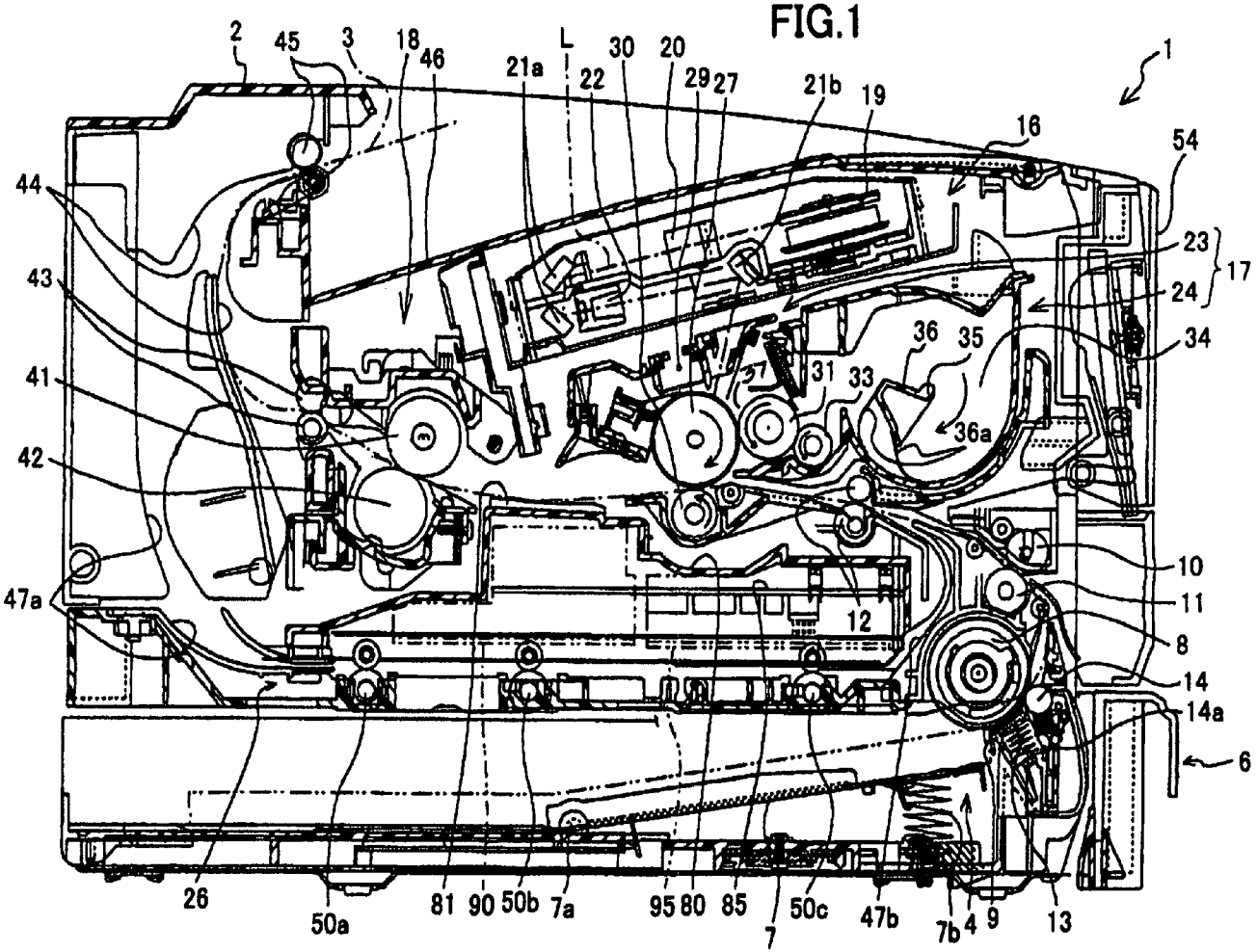
FIG. 1 is a cross-sectional view showing laser printer 1.

First, overall structure of the laser printer 1 will be described with reference to FIG. 1. FIG. 1 is a cross-sectional view of the laser printer 1.

As shown in cross-section in FIG. 1, the laser printer 1 includes a feeder section 4, and an image forming section, all accommodated in a main body case 2. The feeder section 4 is for feeding sheets 3. The image forming section is for forming images on each fed sheet 3, and includes a scanner unit 16, a process cartridge 17, and a fixing unit 18. Note that the right side of FIG. 1 is the front surface of the laser printer 1.

A sheet delivery tray 46 is formed as an upwardly slanting recess located at the upper center surface of the main case body 2. Printed sheets 3 are discharged from the laser printer 1 into a stack on the tray 46. A space that holds a process cartridge 17 is provided in a portion close to the front upper surface of the main body case 2. The space is open to the front side so the process cartridge 17 can be inserted. A cover 54 that pivots downward is provided on a right end side (front side) of the main body case 2. The cover 54 is for covering the space. A process cartridge 17 is inserted and removed where the cover 54 is opened widely.

A sheet delivery path 44 is provided at the rear part in the main body case 2 (left side in FIG. 1). The sheet delivery path 44 is formed in a semi-arc shape that extends vertically along the back of the main body case 2. The sheet delivery path 44 delivers the sheet 3 from a fixing device 18, which is provided on a rear end side in a lower part of the main body case 2, to the sheet delivery tray 46, which is provided on an upper part of the main body case 2. A sheet delivery roller 45 for conveying the sheet 3 is provided along the sheet delivery path 44.

The feeder unit 4 includes a feed roller 8, a paper supply cassette 6, a pressing plate 7, a rubber pad 9, a conveying roller 11, a paper dust removing roller 10, and registration rollers 12. The feed roller 8 is disposed in the lower section of the main casing 2. The paper supply cassette 6 is for holding stacked sheets 3 and is detachably mounted in the bottom section of the main casing 2. The paper supply cassette 6 can be inserted through the front face of the laser printer 1 by moving in a front-to-back direction and removed from the laser printer 1 by moving in a back-to-front direction. The pressing plate 7 is for holding stacked sheets 3 and pressing the sheets 3 against the feed roller 8. The separating pad 9 is disposed above the paper supply cassette 6 and pressed against the feed roller 8 for separating the sheets 3 one sheet at a time in cooperation with the feed roller 8, which is for feeding out the sheets 3. The conveying roller 11 is disposed downstream from the feed roller 8 in the direction for conveying the sheet 3. The paper dust removing roller 10 presses against the conveying roller 11 with the sheet 3 interposed therebetween and removes paper dust from the sheet 3 while conveying the sheet 3 in cooperation with the conveying roller 11. The registration rollers 12 are provided downstream from the conveying roller 11 in the conveying direction of the sheet 3 for regulating the timing at which the sheet 3 is fed for printing.

The pressing plate 7 can stack the sheets 3. A shaft 7*a* attached at one end of the pressing plate 7 is supported on the bottom surface of the paper supply cassette 7 so that the pressing plate 7 is pivotally movable thereabout. Another end of the pressing plate 7 remote from the shaft 7*a* is urged toward the feed roller 8 by a spring 7*b* attached to the bottom surface of the pressing plate 7. The pressing plate 7 is pivotally moved downward against the urging force of the spring 7*b* when the sheets 3 stacked on the pressing plate 7 increases.

The feed roller 8 and the separation pad 9 are disposed in opposition. A spring 13 attached to the rear surface of the separation pad 9 urges the latter toward the feed roller 8.

The paper dust generated by friction between sheet 3 and the separating pad 9 is electrostatically attracted to the paper dust removing roller 14 which is provided to operate in cooperation with the feed roller 8 in the downstream side of the separating pad 9. The sponge 14*a* catch and remove the paper dust. The paper dust which has not removed by the paper dust removing roller 14 is removed by a paper dust removing roller 10 so as not to enter into the image forming section.

Next, the duplex printing unit 26 will be described. The duplex printing unit 26 is disposed above the paper supply cassette 6 and includes reverse conveying rollers 50*a*, 50*b*, and 50*c* arranged in a substantially horizontal orientation. A reverse conveying path 47*a* is provided on the rear side of the reverse conveying roller 50*a* and a reverse conveying path 47*b* is provided on the front side of the reverse conveying roller 50*c*. The reverse conveying path 47*a* extends from the discharge roller 45 to the reverse conveying rollers 50*a* and branches from the discharge path 44 near the end of the discharge path 44 with respect to the sheet feed direction of the sheet 3. The reverse conveying path 47*b*, on the other hand, extends from the reverse conveying roller 50*c* to the registration rollers 12.

When performing duplex printing, first an image is formed on one side of the sheet 3. Then a portion of the sheet 3 is discharged onto the discharge tray 46. When the trailing edge of the sheet 3 becomes interposed between the discharge rollers 45, the discharge rollers 45 stop rotating forward and begin rotating in reverse. At this time, the trailing edge of the sheet 3 contacts the arched surface of the discharge path 44 and is guided along the arched surface to the reverse conveying path 47*a*, without returning to the discharge path 44. The sheet 3 is conveyed from the reverse conveying path 47*a* to the reverse conveying rollers 50*a*, 50*b*, and 50*c* and is subsequently guided to the registration rollers 12 along the reverse conveying path 47*b*. According to this operation, the sheet 3 is conveyed to the image forming unit with its front and back surfaces switched in order to form an image on the other side of the sheet 3.

A low-voltage power source circuit board 90, the high-voltage power source circuit board 95, and an engine circuit board 85 are provided between the duplex printing unit 26 and the image forming unit. A chute 80 formed of a resin is disposed between these circuit boards and the image forming unit to separate these circuit from the fixing unit 18 and the processing cartridge 17. A guide plate 81 provided on the top of the chute 80 for guiding the sheet 3 forms a part of the conveying path of the sheet 3.

The low-voltage power source circuit board 90 functions to drop the voltage supplied from a source external to the laser printer 1, such as a single-phase 100V source, to a voltage of 24V, for example, to be supplied to components in the laser printer 1. The high-voltage power source circuit board 95 generates a high-voltage bias that is applied to components in the processing cartridge 17. The engine circuit board 85 drives a DC motor 86 (FIG. 2), a solenoid (not shown), a laser emitting section (not shown), and the like. The DC motor is the source for driving parts involved in mechanical operations, such as the rollers in the laser printer 1. The solenoid (not shown) is for switching the operating direction of this drive system.

A control board 100 (see FIG. 2) is provided between the right side of the main casing 2 and the frame (not shown) disposed at right side of the main casing 2. This control board 100 controls various parts of the laser printer 1. The control board 100 is disposed in an orientation in which its surface is substantially in parallel to the right side of the main casing 2. Detailed description of the control board 100 will be provided later.

The scanner unit 16 of the image forming section includes a laser beam emitting section (not shown), a polygon mirror 19, an fθ lens 20, reflecting mirrors 21*a*, 21*b*, and a relay lens 22. The laser beam emitting section is located right below the sheet delivery tray 46 of the main body case 2 and irradiates a laser beam. The polygon mirror 19 rotates to scan the laser beam from the laser beam emitting section in a main scanning direction across the surface of a photosensitive drum 27. The fθ lens 20 is for stabilizing scanning speed of the laser beam reflected from the polygon mirror 19. The reflecting mirrors 21*a*, 21*b* are for reflecting the laser beam. The relay lens 22 is for adjusting the focal position in order to focus the laser beam from the reflecting mirror 21 onto the photosensitive drum 27. With this configuration, the laser beam is irradiated from the laser beam emitting section based upon predetermined image data and passes through or is reflected by the polygon mirror 19, the fθ lens 20*a*, the reflecting mirror 21, the relay lens 22 and the fθ lens 20*b* in this order as indicated by an alternate long and dash lines L in FIG. 1 to expose and scan the surface of the photosensitive drum 27 of the process cartridge 17.

The fixing device 18 in the image forming section is disposed downstream from the process cartridge 17 with respect to the direction of sheet transport. The fixing device 18 in the image forming section includes a heating roller 41, a pressing roller 42 for pressing the heating roller 41, and a pair of conveying rollers 43. The conveying rollers 43 are provided downstream from the heating roller 41 and the pressing roller 42. The heating roller 41 is formed by coating a hollow aluminum roller with a fluorocarbon resin and sintering the assembly. The heating roller 41 includes a metal tube and a halogen lamp for heating inside the metal tube. The pressing roller 42 includes a silicon rubber shaft having low hardness that is covered by a tube formed of a fluorocarbon resin. The silicon rubber shaft is urged upward by a spring (not shown), pressing the pressing roller 42 against the heating roller 41. While the sheet 3 from the process cartridge 17 passes between the heating roller 41 and the pressing roller 42, the heating roller 41 pressurizes and heats toner that was transferred onto the sheet 3 in the process cartridge 17, thereby fixing the toner onto the sheet 3. Afterward, the sheet 3 is transported to the sheet delivery path 44 by the conveying rollers 43.

The process cartridge 17 includes a drum cartridge 23 and a developing cartridge 24 that is detachably mounted on the drum cartridge 23. The drum cartridge 23 includes the photosensitive drum 27, a Scorotron charger 29, and a transfer roller 30. The developing cartridge 24 includes a developing roller 31, a supply roller 33, and a toner hopper 34.

The photosensitive drum 27 is arranged in the drum cartridge 23 so as to contact the developing roller 31. The photosensitive drum 27 is rotatable clockwise as indicated by the arrow in FIG. 1. The photosensitive drum 27 includes positively charging organic photo conductor coated on a conductive base material. The positively charging organic photo conductor is made from a charge transfer layer dispersed with a charge generation material. When the photosensitive drum 27 is exposed by a laser beam, the charge generation material absorbs the light and generates a charge. The charge is transferred onto the surface of the photosensitive drum 27 and the conductive base material through the charge transfer layer and counteracts the surface potential charged by the Scorotron charger 29. As a result, a potential difference is generated between regions of the photosensitive drum 27 that were exposed and regions that were not exposed by the laser light. By selectively exposing and scanning the surface of the photosensitive drum 27 with a laser beam based upon image data, an electrostatic latent image is formed on the photosensitive drum 27.

The Scorotron charger 29 is disposed above the photosensitive drum 27. The Scorotron charger 29 is separated from and out of contact with the photosensitive drum 27 by a predetermined distance. The Scorotron charger 29 generates a corona discharge from a wire made from tungsten for example, and is turned ON by a charging bias circuit unit 96 of the high-voltage power source 95 to positively charging the surface of the photosensitive drum 27 to a uniform charge of positive polarity.

The developing roller 31 is disposed further downstream than the Scorotron charger 29 with respect to the rotation direction of the photosensitive drum 27, that is the clockwise direction as viewed in FIG. 1. The developing roller 31 is rotatable counterclockwise as indicated by an arrow in FIG. 1. The developing roller 31 includes a roller shaft made from metal covered with a roller made from a conductive rubber material, A development bias is applied to the developing roller 31 from a development bias circuit unit 97 of the high-voltage power source 95.

The supply roller 33 is rotatably disposed beside the developing roller 31 on the opposite side from the photosensitive drum 27 across the developing roller 31. The supply roller 33 is in pressed contact with the developing roller 31. The supply roller 33 includes a roller shaft made of metal coated with a roller made of a conductive foam material and is adapted to triboelectrify toner supplied to the developing roller 31. Furthermore, the supply roller 33 is rotatable counterclockwise as indicated by an arrow in FIG. 1. This is the same rotation direction as developing roller 31.

The toner hopper 34 is provided beside the supply roller 33. The inside of the toner hopper 34 is filled with developer to be supplied to the developing roller 31 by the supply roller 33. In this embodiment, non-magnetic, single-component toner with a positive charging nature is used as a developer. The toner is a polymeric toner obtained by copolymerizing polymeric monomers using a well-known polymerization method such as suspension polymerization. Examples of polymeric monomers include styrene monomers and acrylic monomers. Styrene is an example of a styrene monomer. Examples of acrylic monomers include acrylic acid, alkyl (C1 to C4) acrylate, and alkyl (C1 to C4) methacrylate. A coloring agent, such as carbon black, and wax are mixed in the polymeric toner. An externally added agent such as silica is also added in order to improve fluidity. Particle diameter of the polymeric toner is approximately 6 to 10 μm.

An agitator 36 is provided for agitating toner accommodated in the toner hopper 34 and supplying the toner into a developing chamber 37. The agitator 36 has a coarse mesh-like plate shape extending in the axial direction (near-to-far direction in FIG. 1) and has a bend in the middle when viewed as a cross-section. A rotating shaft 35 is disposed on one end of the agitator 36. Film members 36*a* for scraping the inner wall of the toner hopper 34 are provided on the other end of the agitator 36 and in the bend in the middle of the agitator 36. The rotating shaft 35 is rotatably supported in the center of both lengthwise ends of the toner hopper 34 and, hence, supports the agitator 36. When the agitator 36 is rotated in the direction indicated by the arrow, toner accommodated in the toner hopper 34 is agitated and supplied into the developing chamber 37.

The transfer roller 30 is disposed below the photosensitive drum 27 and downstream from the developing roller 31 with respect to the rotating direction of the photosensitive drum 27. The transfer roller 30 is rotatable counterclockwise as indicated by an arrow in FIG. 1. The transfer roller 30 includes a metal roller shaft coated with a roller made from an ion-conductive rubber material. During the transfer process, a transfer bias circuit unit 98 of the high-voltage power source 95 applies a transfer forward bias to the transfer roller 30. The transfer forward bias generates a potential difference between the surfaces of the photosensitive drum 27 and the transfer roller 30. The potential difference electrically attracts toner that electrostatically clings to the surface of the photosensitive drum 27 toward the surface of the transfer roller 30.

Figure 2:
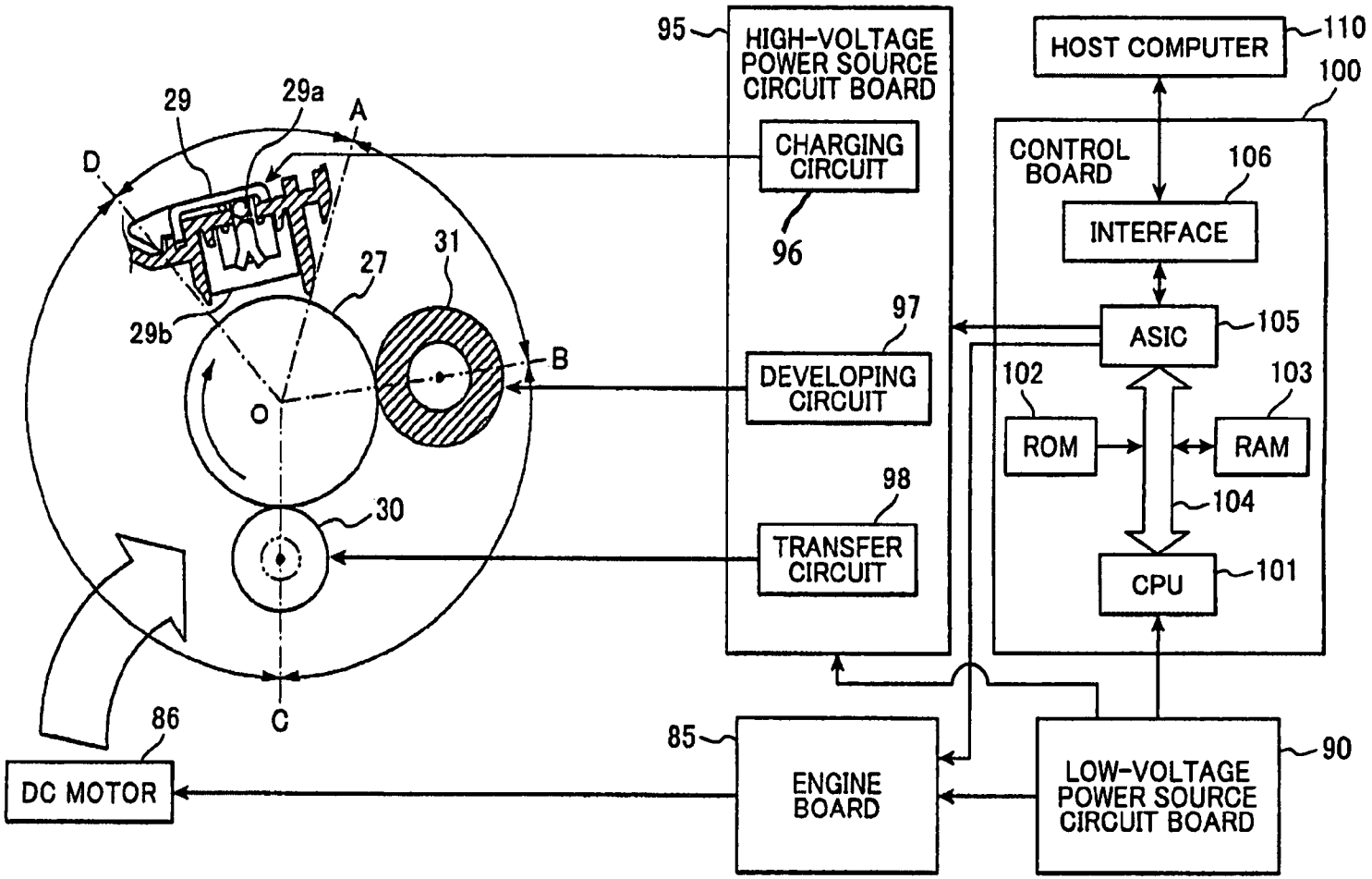
FIG. 2 is a block diagram showing the electrical design of laser printer 1.

The following describes the electrical structure of laser printer 1 with reference to FIG. 2. FIG. 2 is a block diagram of the electrical structure of laser printer 1.

As shown in FIG. 2, a control board 100 contains CPU 101, ROM 102, RAM 103, ASIC (Application Specific Integrated Circuit) 105 and interface 106. CPU 101 includes ROM 102, RAM 103 and ASIC 105, all of which are connected by bus 104, while ASIC 105 is connected to the interface 106. CPU 101 executes programs stored in ROM 102, stores data temporarily in RAM 103 and sends and receives commands for device control via ASIC 105. ASIC is a custom all-in-one IC containing a number of basic circuits and the major control circuit of the image forming device. Control circuit 100 is the control unit of this invention.

The ASIC 105 is connected to a high-voltage power source circuit board 95 and an engine circuit board 85. The high-voltage power source circuit board 95 incorporates a charging bias circuit unit 96, a development bias circuit unit 97 and a transfer bias circuit unit 98. The bias generated by each circuit is applied to a Scorotron charger 29, developing roller 31 and transfer roller 30.

A DC motor 86 connected to the engine circuit board 85 provides photosensitive drum 27, developing roller 31 and transfer roller 30 with driving force via the drive system (not shown) to rotate each roller. The drive system is equipped with gears to distribute and transmit driving force from the DC motor 86. An agitator 36 (FIG. 1) receives driving force from the DC motor 86 to stir the toner. The DC motor 86 is the driving unit of the invention. Charging bias circuit unit 96, development bias circuit unit 97 and transfer bias circuit unit 98 correspond to the "charging bias applying units, developing bias applying unit" and the transfer bias applying unit, respectively.

A low-voltage power source circuit board 90 is connected to and provides power to the control board 100, the high-voltage power source circuit board 95 and the engine circuit board 85. Host computer 110, connected to interface 106 on control board 100, sends print data to laser printer 1.

The following describes print operations of laser printer 1 with reference to FIGS. 1 and 2. When host computer 110 sends print data, the DC motor 86 is turned on, the charging bias is applied to the Scorotron charger 29 and the developing bias is applied to the developing roller 31. Then a reverse transfer bias is applied to the transfer roller 30 to move toner adhering to the transfer roller 30 to the photosensitive drum 27 and clean the transfer roller 30. The Scorotron charger 29 charges the toner on the photosensitive drum 27 and the developing roller 31 collects the charged toner. After this, a transfer bias is applied to transfer roller 30. Then CPU 101 outputs a print start signal, friction occurring between sheet 3 and the feed roller 6 causes sheet 3 to be grabbed and fed after which sheet 3 is pinched between the feed roller 8 and the rubber pad 9. Single sheet 3 goes through paper dust removing rollers 14 and 10 to remove paper dust and is then fed to registration rollers 12 by conveying roller 11. In feeding sheet 3, the registration rollers 12 align the front edge of sheet 3 with the front edge of the image formed on the surface of the rotating photosensitive drum 27.

An engine controller (not shown) in the engine circuit board 85 of a scanner unit 16 generates a laser drive signal. A laser beam emitting section (not shown) uses the laser drive signal to produce a laser beam that is irradiated onto a polygon mirror 19. The polygon mirror 19 scans the irradiated laser beam in the main scanning direction (perpendicular to sheet 3 feed direction) and outputs the laser beam via fθ lens 20. The fθ lens 20 converts the laser beam scanned by the polygon mirror 19 from constant angular velocity to constant linear velocity. The laser beam is redirected by a reflecting mirror 21*a*, focused by a cylindrical lens 22 and is sent through a reflecting mirror lens 21*b* to form an image on the surface of the photosensitive drum 27.

The surface of the photosensitive drum 27 is charged to about 1000 V by the Scorotron charger 29 to which the charging bias circuit unit 96 on the high-voltage power source circuit board 95 applies a charging bias. The photosensitive drum 27, which rotates in the direction of the arrow (clockwise in FIG. 1) is then irradiated by the laser beam. The laser beam irradiates the image area in the main scanning direction on sheet 3, while areas where no image is to be formed are not irradiated. The surface potential of areas irradiated by the laser beam (the light areas) is lowered to about 200 V. The laser beam also irradiates the sheet in the sub-scanning direction (the feeding direction of sheet 3) as the photosensitive drum 27 rotates. The areas not irradiated by the laser beam (dark areas) and the bright areas form an electrical non-visible image, the electrostatic latent image, on the photosensitive drum 27.

The toner in a toner hopper 34 is conveyed to a supply roller 33 by the rotation of the agitator 36. The rotation of the supply roller 33 conveys the toner to the developing roller 31. At this time, the toner is positively charged by friction between the supply roller 33 and developing roller 31. Then the toner is distributed in a thin layer of uniform thickness and fed by developing roller 31. A positive developing bias of about 400 V is applied to the developing roller 31. The toner conveyed by developing roller 31 rotation and positively charged by the developing roller 31 is transferred to the electrostatic latent image formed on the photosensitive drum 27 surface when brought into contact with the photosensitive drum 27. Since the potential of the developing roller 31 is lower than the potential of the dark areas (+1000 V), but higher than the light areas (+200 V), the toner is selectively transferred to the bright areas, which have a low potential. In this way, a visible image, an image developed by the toner is formed on the photosensitive drum 27.

When the sheet 3 passes between the photosensitive drum 27 and the transfer roller 30, the potential (+200 V) of the bright areas drop further. A forward transfer bias, a constant current with a load (in voltage) of about −1000 V, is applied to the transfer roller 30 and the visible image on the photosensitive drum 27 is transferred to sheet 3.

Sheet 3 to which the toner has been transferred is conveyed to a fixing unit 18. Sheet 3 with the toner attached goes between a heating roller 41 and a pressing roller 42, both located in the fixing unit 18. Here sheet 3 is heated to a temperature of about 200° C. while pressure is applied to melt the toner and form a permanent image on the sheet 3. Both the heating roller 41 and the pressing roller 42 contain a diode that ensure the surface potential of the the pressing roller 42 is lower than the surface potential of heating roller 41. For this reason, positively charged toner adhering to the heating roller 41 side of sheet 3 is electrically attracted by pressing roller 42. This prevents the toner from being attracted to the heating roller 41 during heating and soil the image.

After toner on sheet 3 has been heated and subjected to pressure, a pair of conveying rollers 43 conveys and ejects sheet 3 via a sheet delivery path 44 into sheet delivery tray 46 with the print side down. Subsequent sheets 3 that are printed are stacked on top of the previously ejected sheet 3 in the sheet delivery tray 46 with the print side down. In this way, the user is provided with a document where sheets 3 are arranged in print order.

In laser printer 1, after toner has been transferred from the photosensitive drum 27 to sheet 3 by the transfer roller 30, the developing roller 31 collects the toner that still remains on photosensitive drum 27 to provide a cleanerless developing system.

The following describes control after completion of printing in laser printer 1 with reference to FIG. 2. In this embodiment of laser printer 1, the following happens when the surface of the photosensitive drum 27 that is charged to about 1000 V by the Scorotron charger 29 passes the nip area (indicated by point C in FIG. 2) between the photosensitive drum 27 and the transfer roller 30. A −14 μA constant current transfer bias is applied (for example, when printing plain paper such as copying paper) and the transfer roller 30 whose potential of about −1000 V attenuates the remaining charges at point C on the photosensitive drum 27 to a low potential of about 300 V. Next, when this area of the drum reaches a position opposite charging electrode 29 a in Scorotron charger 29 (point A in FIG. 2) this area is charged to about 1000 V by Scorotron charger 29.

If the above operation is continued while the photosensitive drum 27 is stopped, the stopped photosensitive drum 27 is charged continuously at point A, which reduces the service life of photosensitive drum 27. For this reason, the application of the charging bias to the Scorotron charger 29 must stop before photosensitive drum 27 stops. And when the driving force from the DC motor 86 stops the photosensitive drum 27 does not stop immediately but continues rotating at a continuously reduced speed for half or one rotation before coming to a complete stop. If the commands to stop the DC motor 86, the charging bias, transfer bias and developing bias are output simultaneously, the surface potential at point C on the photosensitive drum 27 that has dropped to about 300 V, will through idling reach the nip area (point B in FIG. 2) with the developing roller 31 maintaining the same voltage. At this time, the toner on the developing roller 31 still maintains a charge of about 400 V causing the positively charged toner on the developing roller to stick to the photosensitive drum whose surface has a voltage of about 300 V.

When printing is performed in the above conditions on plain paper as sheet 3, the potential difference between the developing roller 31 and the photosensitive drum 27 is about 100 V. The toner that still adheres to the photosensitive drum 27 after printing that soils the rear of sheet 3 due to cleaning performed by the transfer roller 30 at the start of next printing is negligible. Experiments have shown that this amount can be ignored in the operation of laser printer 1. However, when the user is printing on postcards or other media as sheet 3, a −30 μA constant current transfer bias is applied to maintain transfer efficiency during printing. Then the potential of transfer roller 30 becomes about −2000 V and the surface potential of photosensitive drum 27 drops to about 80 V at point C. This increases the amount of toner that is transferred from developing roller 31 to photosensitive drum 27 and the soiling that occurs on the rear of sheet 3 at next printing is now clearly noticeable. Laser printer 1 performs control to prevent this from happening when printing ends. A transfer bias of −14 μA constant current applied to transfer roller 30 is referred to as "Mode 1" in this invention, while a transfer bias of −30 μA constant current is referred to as "Mode 2".

At the time of printing with laser printer 1, host computer 110 sends data that includes information on the type of sheet 3 to CPU 101 via interface 106 and ASIC 105. CPU 101 uses this information to determine the constant current to apply to transfer roller 30 and sends a signal to a transfer bias circuit unit 98 via ASIC 105 to generate a −14 μA or −30 μA constant current transfer bias during printing.

The long side of the rectangular Scorotron charger 29 faces the axis of rotation of the photosensitive drum 27. The grid electrode **29*b* on the Scorotron charger 29 stabilizes the discharge of the charging electrode 29*a* to ensure stable charging of the surface of photosensitive drum 27. The surface potential of the photosensitive drum 27 does not rise instantaneously when charged. The surface potential rises gradually as the photosensitive drum 27 rotates in the area between point D (the edge of the electrode 29*b* that is in the upstream section of the Scorotron charger 29 in the moving direction of the photosensitive drum 27) and point A and definitely reaches 1000 V at point A. Thus the reference point for the opposed position of the Scorotron charger 29 relative to the photosensitive drum 27** for this invention is point A.

Figure 3:
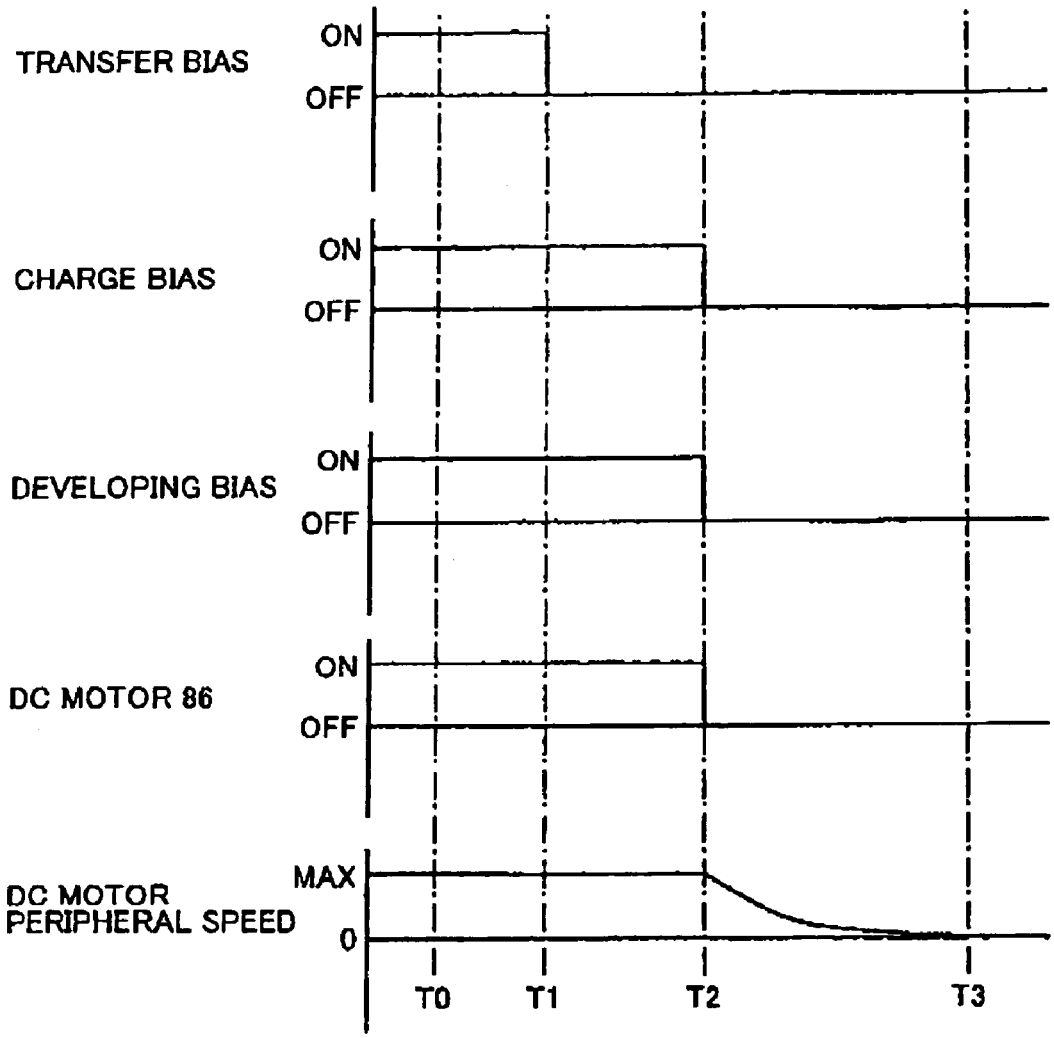
FIG. 3 is a timing chart showing the control timing of image forming device components at the end of printing.

As shown in FIG. 2, when laser printer 1 has printed the print data sent from the host computer 110, drive power to DC motor 86 stops and a process to stop photosensitive drum 27 and other rotating components is performed. This process uses the time when the bottom edge of sheet 3 in the feed direction passes point C (the timing required in experiments testing responses from jam sensors or other sensors (not shown)) to cause CPU 101 to execute an End Print program stored in ROM 102. End of toner collection after the transfer operation described above is the trigger that starts the End Print program. CPU 101 sends signals to the high-voltage power source circuit board 95 and engine circuit board 85 via ASIC 105 according to the End Print program and the timing chart in FIG. 3 to perform control of the charging bias, developing bias, transfer bias and drive of DC motor 86. FIG. 3 is a timing chart that shows the timing of control of image forming device components at the end of printing.

As shown in FIG. 3, the T0 standard timing (the timing used as the standard for running the End Print program) for ending printing by laser printer 1 is the application of the charging bias, developing bias and transfer bias to the Scorotron charger 29, developing roller 31 and transfer roller 30, respectively. These biases are continuously applied to the rotating photosensitive drum 27 prior to T0 and periods between T0 and T1. For this reason, as stated above, the potential of surface area AC in the rotation direction of the photosensitive drum 27 in FIG. 2 (below all areas on the drum are indicated by assigning the points they occupy in clockwise order (the rotation direction of the photosensitive drum 27). Thus AC indicates the area starting from point A to point C in the rotation direction of photosensitive drum 27 that includes point B. The word "point" is omitted in area names.) is about 1000 V. The potential for the area CA during printing of cards and other media is about 80 V.

At T1, a prescribed time period after T0, CPU 101 sends a signal to the transfer bias circuit unit 98 via ASIC 105 to stop the application of the transfer bias to the transfer roller 30. The surface potential of about 1000 V of the photosensitive drum 27 in the AC area is therefore not affected by the transfer bias even when the photosensitive drum 27 reaches point C. The surface potential of the photosensitive drum 27 will thus still be about 1000 V when it is located in area CA in the period between T1 and T2.

CPU 101 sends a signal to the engine circuit board 85 to stop DC motor 86 drive at T2.

The period between timing T1 and T2 is obtained based on the period of rotational movement from point C to point A when the surface area of the photosensitive drum 27 rotates slowly during printing. In this example, the photosensitive drum 27 makes one rotation in 889 ms during the slow rotation of the photosensitive drum 27 in printing. The photosensitive drum 27 is designed such that the angle COA between point C and point A with rotation axis O of the photosensitive drum 27 at the center is 194.7° and it takes 481 ms for the photosensitive drum 27 to go from point C to reach point A. Thus T1 is set at least 481 ms prior to T2. Determining the period between T1 and T2 in this why means that the surface of the photosensitive drum 27 which is at point C at T1, will at least reach point A or a point further away from point A in clockwise direction at T2. The photosensitive drum 27 whose surface potential for area CA is about 80 V at T1 moves to a position inside the AC area at T2. Thus at T2 the surface potential of the photosensitive drum 27 at point A is the same as the potential for area AC at T1 or about 1000 V.

At T2, CPU 101 transmits a signal to a charging bias circuit unit 96 and development bias circuit unit 97 via ASIC 105. This signal stops the application of the charging bias and developing bias to the Scorotron charger 29 and the developing roller 31, respectively. The DC motor 86 stops completely at T3, but since the surface potential of photosensitive drum 27 at point B is maintained at a higher value than the developing roller 31 during the period between T2 and T3, the toner on the developing roller 31 does not transfer to the photosensitive drum 27.

As described above, in this embodiment of laser printer 1, the surface potential of the photosensitive drum 27 is charged to 1000 V by the Scorotron charger 29 at point A. Control at end of printing stops transfer bias application to the transfer roller 30 at T1. The surface of the photosensitive drum 27, whose potential is lowered from about 1000 V to about 80 V by the transfer bias: applied prior to T1, is charged to 1000 V upon reaching point A at T2. Even if the application of the charging bias to the Scorotron charger 29 stops at T2, the surface area of the photosensitive drum 27 that passes point A after T2 is not affected by the transfer bias, thus the surface potential of all areas of the photosensitive drum 27 is about 1000 V. For this reason, the potential of the photosensitive drum 27 is higher than the potential of the developing roller 31 after T2 and prevents the toner on the developing roller 31 from transferring to the photosensitive drum 27. And even if the photosensitive drum 27 stops completely at T3, the application of the charging bias to the Scorotron charger 29 has already stopped. The photosensitive drum 27 is thus not being charged at any point preventing premature reduction of photosensitive drum 27 service life.

The prescribed timing relationship is maintained in this invention. Thus the End Print program starts (T0) when the rotation of the photosensitive drum 27 stops and the developing roller 31, which is driven by the same drive system as the photosensitive drum 27, also stops (T2). For this reason, the rotation of the agitator 36, which is driven by DC motor 86 maintains the same rotation speed as the motor preventing premature toner deterioration.

This invention can be modified in a number of ways. For example, in this embodiment of the invention the application of the transfer bias to the transfer roller 30 is stopped at T1. However, instead of stopping the transfer bias, the constant current of the bias that is applied can be changed from, for example, −30 μA to −14 μA to minimize the soiling on the rear side of sheet 3 when plain paper is used. Termination of charging bias application can be extended from T2 to T3. Transfer bias termination (FIG. 3) can be changed from T1 by determining through experiments when the photosensitive drum 27 area located at point A at termination of the charging bias was last positioned at point C.

Figure 4:
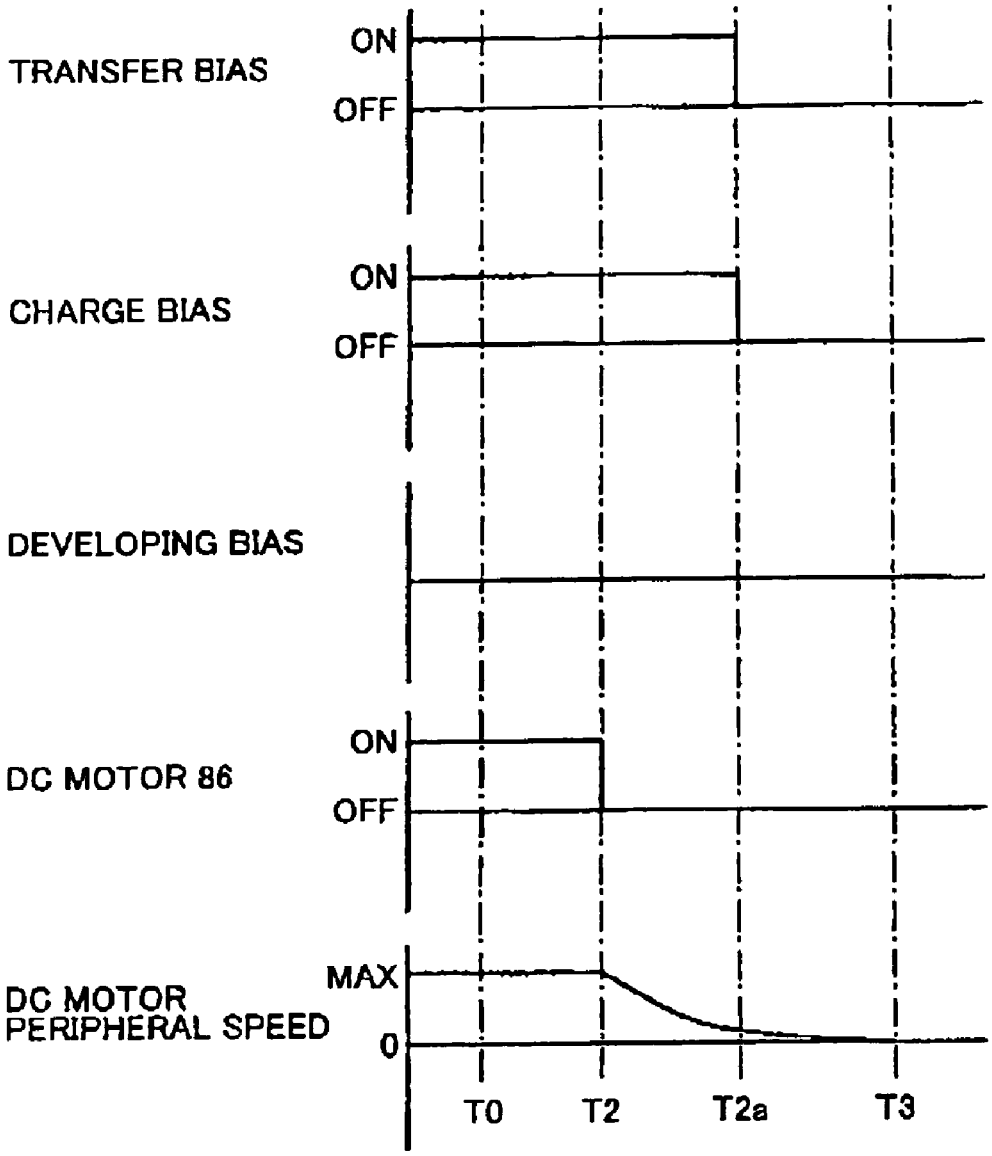
FIG. 4 is a timing chart showing the control timing for a modification of image forming device components at the end of printing.
Figure 5:
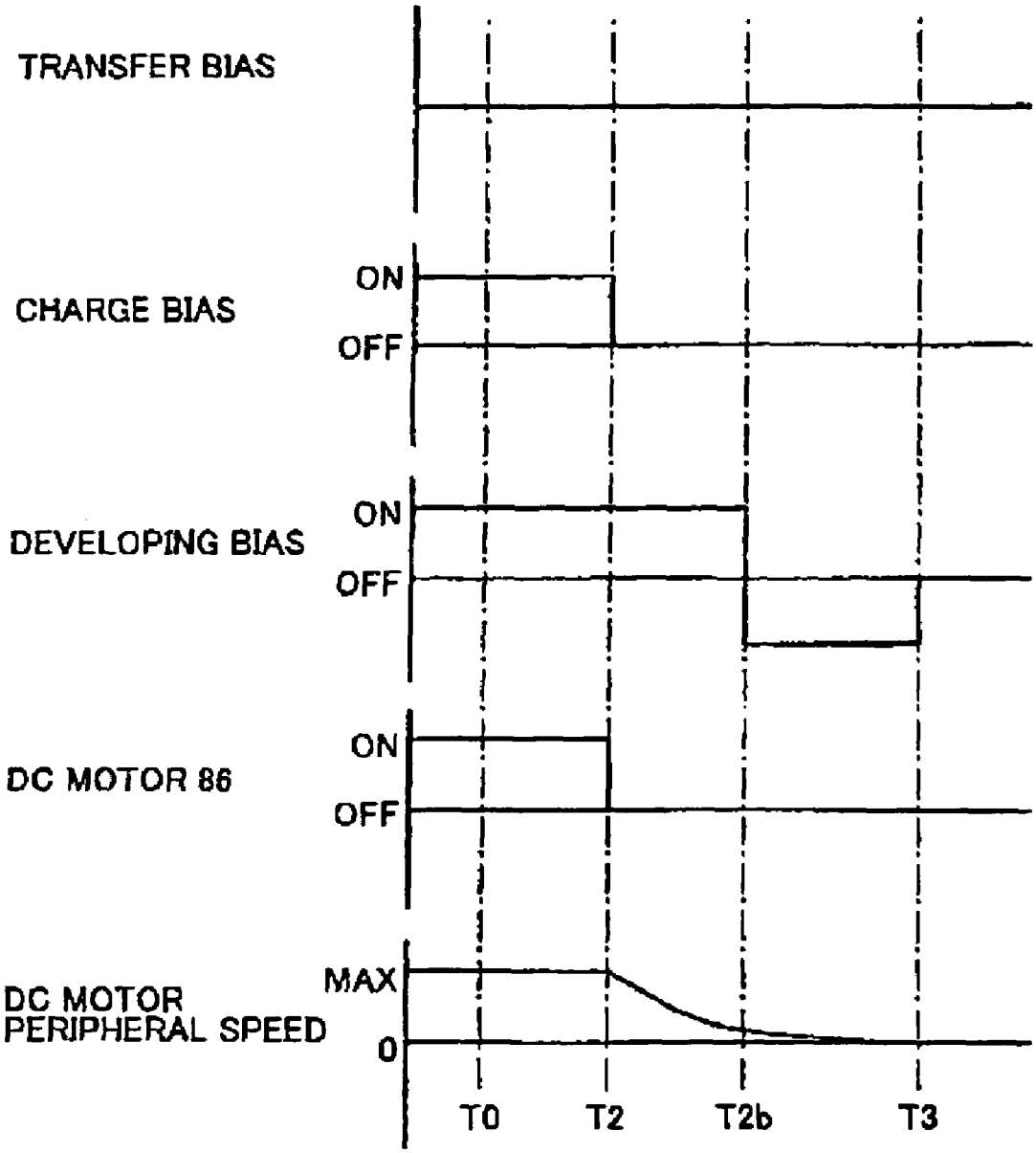
FIG. 5 is a timing chart showing the control timing for a modification of image forming device components at the end of printing.
Figure 6:
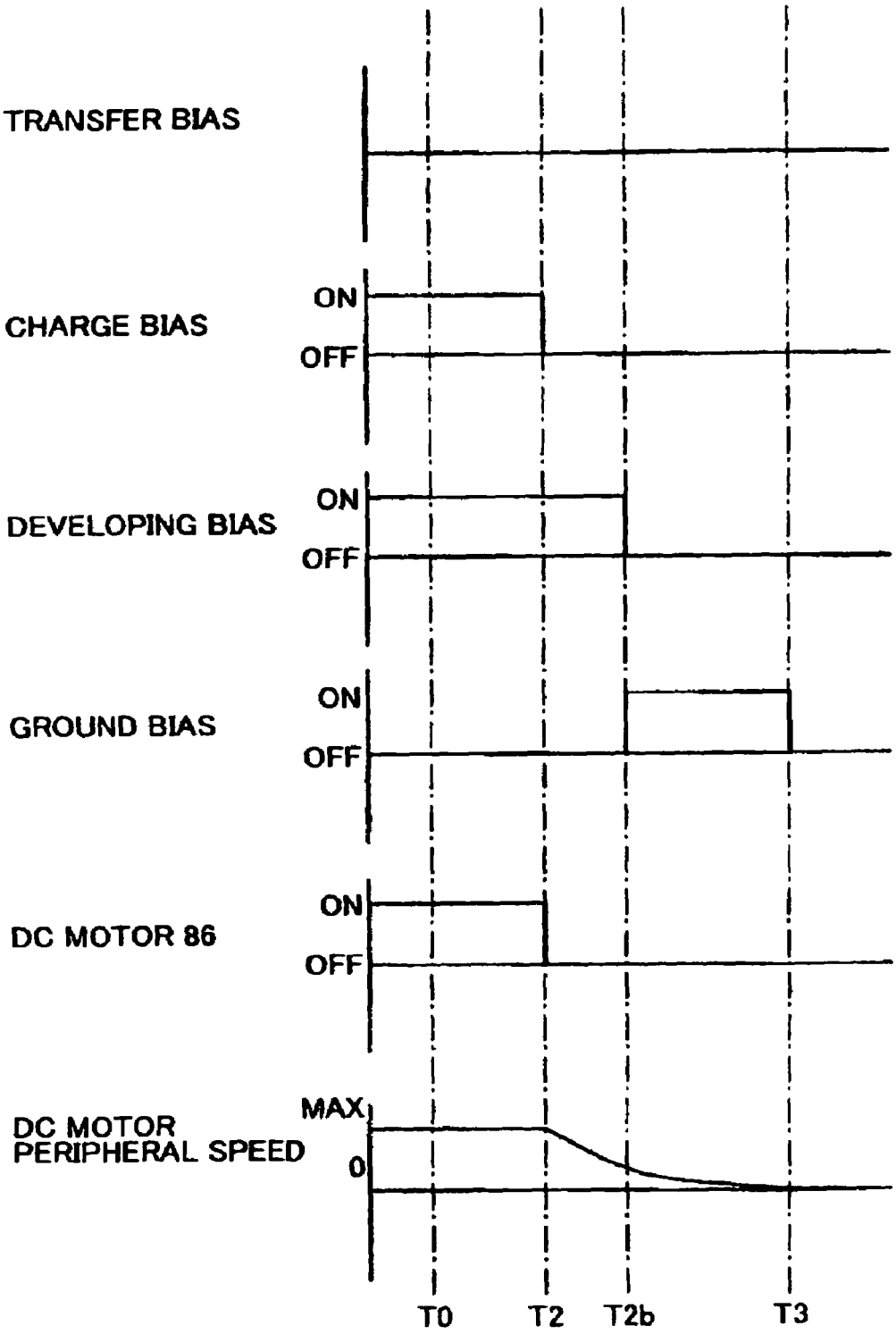
FIG. 6 is a timing chart showing the control timing for a modification of image forming device components at the end of printing.

As shown in FIG. 4 through FIG. 6, adjusting the control timing of each bias based on the End Print program allows you to obtain the same effect as this invention. For example, in the modification shown in FIG. 4, CPU 101 executes the End Print program at T0 and each control is handled by the program, like in this embodiment of the invention. First, the DC motor 86 stops at T2. Then at T2*a* the application of the charging bias to the Scorotron charger 29 and the transfer bias to the transfer roller 30 stop. At T3, the photosensitive drum 27 comes to a complete stop, however in the period T2*a* to T3, progress of the photosensitive drum 27 in area AB is timed so that the surface area at point A of photosensitive drum 27 at T2*a* does not reach point B at T3.

As stated above, the photosensitive drum 27 is designed to perform one rotation in 889 ms and that angle AOB between point A and point B with rotation axis O of the photosensitive drum 27 at the center is 66.1°. The diameter of the photosensitive drum 27 is 30 mm, the circumference is 94.2 mm and the AB distance is 17.3 mm. If the peripheral velocity of the photosensitive drum 27 in the period T2*a* and T3 is f (t) (time function t), the following formula can be used to obtain the T2*a* and T3 timing relationship.

$$\int_{T2a}^{T3} f(t)dt < \text{distance of area } AB$$

T3, that is the time when the photosensitive drum 27 comes to a complete stop after the DC motor 86 has stopped, can be obtained in experiments and be used to obtain the T2*a* timing.

The surface potential of the photosensitive drum 27 in area AC during the T0 to T2*a* period is about 1000 V while the potential in area CA is about 80 V. When the application of the charging bias stops at T2*a*, the photosensitive drum 27 idles from point A to point B and the surface potential of area AB is about 80 V. However, the photosensitive drum 27 comes to a complete stop before this surface area reaches point B. Thus the potential of the photosensitive drum 27 at point B maintains about 1000 V in the period between T0 and T3, a higher potential than the potential of the developing roller 31 so the toner on the surface of the developing roller is not transferred to the photosensitive drum 27.

The modification shown in FIG. 4 shows how it is possible to stop the application of the charging bias to prevent local charging of the photosensitive drum 27 when the photosensitive drum 27 comes to a complete stop. In this modification, the application of the transfer bias could be stopped prior to T2*a* (for example, T2). No restrictions apply to the control timing of the developing bias.

In the modification shown in FIG. 5, CPU 101 executes the End Print program at T0 and each control is handled by the program, like in this embodiment of the invention. Drive to the DC motor 86 and the application of charging bias to the Scorotron charger 29 stops at T2. Then at T2*b* the application of the developing bias (400 V) to the developing roller 31 is switched to a reverse polarity developing bias (for example, −100 V).

The rotation of the photosensitive drum 27 is timed so that the photosensitive drum 27 is within the area AB in the T2 to T2*b* period and the surface area of photosensitive drum 27 at point A at T2 does not reach point B at T2*b*. If, like the above modification, the peripheral velocity of the photosensitive drum 27 is f (t) (time function t), the following formula can be used to obtain the T2 and T2*b* timing relationship.

$$\int_{T2}^{T2b} f(t)dt \leqq \text{distance of area } AB$$

Like the above modification, T3, the time when the photosensitive drum 27 comes to a complete stop, can be established by experiments. The application of the reverse developing bias to the developing roller 31 stops at T3.

The surface potential of the photosensitive drum 27 in area AC is about 1000 V while the potential in area CA is about 80 V until the application of the charging bias to the Scorotron charger stops at T2. The photosensitive drum 27 starts idling from T2 and the surface area that is at point A at T2 reaches point B at T2*b*. Thus the surface potential of the photosensitive drum 27 at point B at T2*b* drops from about 1000 V to about 80 V. However, a reverse developing bias of about −100 V is applied to the developing roller 31 at T2*b* thus the potential of the developing roller 31 is lower than the potential of the surface of the photosensitive drum 27 at point B also in the period T2*b* to T3. This maintains the transfer direction of the toner to prevent the toner on the developing roller from transferring to the photosensitive drum 27.

Also the modification shown in FIG. 5 makes it possible to stop the application of the charging bias before the photosensitive drum 27 comes to a complete stop thereby preventing the photosensitive drum 27 from exposure to local charging. The application of the charging bias can be stopped after T2, for example, in the period between T2 and T2*b* while the reverse developing bias can be stopped after T3 in this modification. No restrictions apply to the control timing of the developing bias.

The controls performed in the T0 to T2*b* period in the modification shown in FIG. 6 are identical to those performed in the modification in FIG. 5. When the application of the developing bias to the developing roller 31 stops at T2*b*, a ground bias of about 500 V is applied to the ground electrode of the photosensitive drum 27. The ground bias is generated when CPU 101 transmits a signal to a ground circuit unit (not shown), which is part of the high-voltage power source circuit board 95 (FIG. 2), via ASIC 105 as dictated by the instructions of the End Print program. The ground electrode on the photosensitive drum 27 is connected to the ground circuit unit, which functions as a ground terminal when the ground bias is not applied.

When the charging bias ends at T2, the surface area of the photosensitive drum 27 enters the AB area having a potential of about 80 V. When the photosensitive drum 27 reaches point B at T2*b*, the potential of the entire photosensitive drum 27 is increased by about 500 V so that the surface potential of the photosensitive drum 27 at point B becomes 580 V. For this reason, the potential of the developing roller 31 is lower than the surface potential of the photosensitive drum 27 at point B also in the period T2*b* to T3. This maintains the direction of toner movement, which is determined by potential difference, and prevents the transfer of toner from the developing roller 31 to the photosensitive drum 27.

Also the modification shown in FIG. 6 makes it possible to stop the application of the charging bias before the photosensitive drum 27 comes to a complete stop thereby preventing the photosensitive drum 27 from exposure to local charging. The application of the charging bias can be stopped after T2, for example, in the period between T2 and T2*b*. The developing bias is stopped after T2*b*, but no restrictions apply to the control timing of the developing bias.

The same result could also be achieved by slowing down the idling of the photosensitive drum 27 thereby making sure that the surface area of the photosensitive drum 27 that is affected by the transfer bias applied to the transfer roller 30 does not reach a position opposite the developing roller 31. This could be done by for example providing a brake such as an electromagnetic clutch in the drive system to prevent idling by the photosensitive drum 27 when the DC motor 86 stops. Or add an elastic element to the axis of rotation of the photosensitive drum 27 that applies a friction load to the photosensitive drum 27 and slows down idling. Or, again, by reversing the polarity of each applied bias would make it possible to use this invention with negatively charged toner (negatively charged photosensitive system).

What is claimed is:

1. An image forming device comprising:

a photosensitive drum rotatable in a predetermined direction about an axis and having a peripheral surface on which an electrostatic latent image is formed;

a driving unit;

a drive signal generating unit that generates a drive signal to be applied to the driving unit, the driving unit rotating the photosensitive drum in response to the drive signal;

a charging unit that is disposed in confrontation with the photosensitive drum and electrically charges the photosensitive drum;

a charging bias applying unit that applies a charging bias to the charging unit;

a developing agent bearing member that is disposed in confrontation with the photosensitive drum in a position further downstream than the charging unit with respect to the predetermined direction in which the photosensitive drum rotates, the developing agent bearing member forming a developed image on the photosensitive drum by applying developing agent on the electrostatic latent image on the photosensitive drum;

a transfer unit that is disposed in confrontation with the photosensitive drum in a position further upstream than the charging unit with respect to the predetermined direction but further downstream than the developing agent bearing member, the transfer unit transferring the developed image on the photosensitive drum onto a recording medium;

a control unit that controls the charging bias applying unit to terminate application of the charging bias to the charging unit at a time before rotations of the photosensitive drum stops completely by interrupting application of the drive signal from the drive signal generating unit to the driving unit, and controls a potential between the photosensitive drum and the developing agent bearing member so that a lesser amount of the developing agent on the developing agent bearing member adheres to the photosensitive drum before the photosensitive drum stops completely, and a transfer bias to the transfer unit, wherein when an area on the photosensitive drum opposite the transfer unit reaches a position opposite the charging unit resulting from the rotation of the photosensitive drum after a first predetermined time period, the control unit controls the transfer bias applying unit to switch the transfer bias at a transfer bias switching time that precedes the first predetermined time period from a time when application of the charging bias is stopped so that a lesser amount of the developing agent on the developing agent bearing member adheres to the photosensitive drum before the photosensitive drum stops completely.

2. The image forming device according to claim 1, wherein the control unit controls the transfer bias applying unit to stop applying the transfer bias at the transfer bias switching time and generates a potential difference between the photosensitive drum and the developing agent bearing member so that static electric force imparted from the photosensitive drum to the developing agent bearing member acts on the developing agent.

3. The image forming device according to claim 1, wherein the transfer bias applying unit has a first mode for applying a first transfer bias to the transfer unit when the developed image is transferred onto the recording medium, and a second mode for applying a second transfer bias to the transfer unit, the second transfer bias generating a greater potential difference between the photosensitive drum and the transfer device than the first transfer bias, and wherein the control unit controls the transfer bias applying unit at the transfer bias switching timing at least when the transfer bias applying unit is in the second mode.

4. The image forming device according to claim 3, wherein the control unit controls the transfer bias applying unit, when the transfer bias applying unit is in the second mode, to switch from the second transfer bias to the first transfer bias at the transfer bias switching timing.

5. The image forming device according to claim 1, wherein the developing agent bearing member collects the developing agent remaining on the photosensitive drum after passing through the transfer unit.

6. An image forming device comprising:

a photosensitive drum rotatable in a predetermined direction about an axis and having a peripheral surface on which an electrostatic latent image is formed a driving unit;

a drive signal generating unit that generates a drive signal to be applied to the driving unit, the driving unit rotating the photosensitive drum in response to the drive signal;

a charging unit that is disposed in confrontation with the photosensitive drum and electrically charges the photosensitive drum;

a charging bias applying unit that applies a charging bias to the charging unit;

a developing agent bearing member that is disposed in confrontation with the photosensitive drum in a position further downstream than the charging unit with respect to the predetermined direction in which the photosensitive drum rotates, the developing agent bearing member forming a developed image on the photosensitive drum by applying developing agent on the electrostatic latent image on the photosensitive drum;

a transfer unit that is disposed in confrontation with the photosensitive drum in a position further upstream than the charging unit with respect to the predetermined direction but further downstream than the developing agent bearing member, the transfer unit transferring the developed image on the photosensitive drum onto a recording medium;

a control unit that controls the charging bias applying unit to terminate application of the charging bias to the charging unit at a time before rotations of the photosensitive drum stops completely by interrupting application of the drive signal from the drive signal generating unit to the driving unit, and controls a potential between the photosensitive drum and the developing agent bearing member so that a lesser amount of the developing agent on the developing agent bearing member adheres to the photosensitive drum before the photosensitive drum stops completely, wherein the control unit controls the charging bias applying unit to stop applying the charging bias after the drive signal from the drive signal generating unit to the driving unit stops but before the photosensitive drum stops completely.

7. The image forming device according to claim 6, wherein the developing agent bearing member collects the developing agent remaining on the photosensitive drum after passing through the transfer unit.

8. An image forming device comprising:

a photosensitive drum rotatable in a predetermined direction about an axis and having a peripheral surface on which an electrostatic latent image is formed;

a driving unit;

a drive signal generating unit that generates a drive signal to be applied to the driving unit, the driving unit rotating the photosensitive drum in response to the drive signal;

a charging unit that is disposed in confrontation with the photosensitive drum and electrically charges the photosensitive drum;

a charging bias applying unit that applies a charging bias to the charging unit;

a developing agent bearing member that is disposed in confrontation with the photosensitive drum in a position further downstream than the charging unit with respect to the predetermined direction in which the photosensitive drum rotates, the developing agent bearing member forming a developed image on the photosensitive drum by applying developing agent on the electrostatic latent image on the photosensitive drum;

a transfer unit that is disposed in confrontation with the photosensitive drum in a position further upstream than the charging unit with respect to the predetermined direction but further downstream than the developing agent bearing member, the transfer unit transferring the developed image on the photosensitive drum onto a recording medium;

a control unit that controls the charging bias applying unit to terminate application of the charging bias to the charging unit at a time before rotations of the photosensitive drum stops completely by interrupting application of the drive signal from the drive signal generating unit to the driving unit, and controls a potential between the photosensitive drum and the developing agent bearing member so that a lesser amount of the developing agent on the developing agent bearing member adheres to the photosensitive drum before the photosensitive drum stops completely, and a developing bias applying unit that applies a developing bias to the developing agent bearing member, wherein when an area on the photosensitive drum opposite the charging unit reaches a position opposite the developing agent bearing member resulting from the rotation of the photosensitive drum after a second predetermined time period, the control unit controls the developing bias applying unit to switch the developing bias at a developing bias switching time that precedes the second predetermined time period from a time when application of the charging bias is stopped.

9. The image forming device according to claim 8, wherein the control unit controls the developing bias applying unit to apply to the developing agent bearing member a developing bias of a reverse polarity with respect to the polarity of the charge of the developing agent at the developing agent switching time, and generates a potential difference between the photosensitive drum and the developing agent bearing member so that static electric force imparted from the photosensitive drum to the developing agent bearing member acts on the developing agent.

10. The image forming device according to claim 9, wherein the control unit controls the developing bias applying unit to stop application of the developing bias of a reverse polarity after the photosensitive drum has completely stopped moving.

11. The image forming device according to claim 8, wherein the developing agent bearing member collects the developing agent remaining on the photosensitive drum after passing through the transfer unit.

12. An image forming device comprising:

a photosensitive drum rotatable in a predetermined direction about an axis and having a peripheral surface on which an electrostatic latent image is formed;

a driving unit;

a drive signal generating unit that generates a drive signal to be applied to the driving unit, the driving unit rotating the photosensitive drum in response to the drive signal;

a charging unit that is disposed in confrontation with the photosensitive drum and electrically charges the photosensitive drum;

a charging bias applying unit that applies a charging bias to the charging unit;

a developing agent bearing member that is disposed in confrontation with the photosensitive drum in a position further downstream than the charging unit with respect to the predetermined direction in which the photosensitive drum rotates, the developing agent bearing member forming a developed image on the photosensitive drum by applying developing agent on the electrostatic latent image on the photosensitive drum;

a transfer unit that is disposed in confrontation with the photosensitive drum in a position further upstream than the charging unit with respect to the predetermined direction but further downstream than the developing agent bearing member, the transfer unit transferring the developed image on the photosensitive drum onto a recording medium;

a control unit that controls the charging bias applying unit to terminate application of the charging bias to the charging unit at a time before rotations of the photosensitive drum stops completely by interrupting application of the drive signal from the drive signal generating unit to the driving unit, and controls a potential between the photosensitive drum and the developing agent bearing member so that a lesser amount of the developing agent on the developing agent bearing member adheres to the photosensitive drum before the photosensitive drum stops completely, and a ground bias applying unit that applies a ground bias to the photosensitive drum, wherein when an area on the photosensitive drum opposite the charging unit reaches a position opposite the developing agent bearing member resulting from the rotation of the photosensitive drum after a second predetermined time period, the control unit controls the ground bias applying unit to switch the ground bias at a ground bias switching time that precedes the second predetermined time period from a time when application of the charging bias is stopped.

13. The image forming device according to claim 12, wherein the control unit controls the ground bias applying unit to switch the ground bias to a bias value greater than the developing bias at the ground bias switching time, and generates a potential difference between the photosensitive drum and the developing agent bearing member so that static electric force imparted from the photosensitive drum to the developing agent bearing member acts on the developing agent.

14. The image forming device according to claim 13, wherein the control unit controls the ground bias applying unit to stop ground bias application when the photosensitive drum has completely stopped moving.

15. The image forming device according to claim 12, wherein the developing agent bearing member collects the developing agent remaining on the photosensitive drum after passing through the transfer unit.

* * * * *